US007557770B2

(12) United States Patent
Caesar

(10) Patent No.: US 7,557,770 B2
(45) Date of Patent: Jul. 7, 2009

(54) METHOD AND APPARATUS FOR SWITCHING BETWEEN INTERNAL AND EXTERNAL ANTENNAS IN A DEVICE SUCH AS PC-CARD MODEM

(75) Inventor: David Caesar, North Vancouver (CA)

(73) Assignee: Sierra Wireless, Inc., Richmond, British Columbia ( * ) Notice: Subject to any disclaimer, the term of this patent is extended or adjusted under 35 U.S.C. 154(b) by 3 days.

(21) Appl. No.: 11/973,220

(22) Filed: Oct. 4, 2007

(65) Prior Publication Data

US 2008/0036681 A1 Feb. 14, 2008

Related U.S. Application Data

(63) Continuation of application No. 11/253,048, filed on Oct. 17, 2005, now Pat. No. 7,295,171.

(51) Int. Cl.
*H01Q 3/24* (2006.01)

(52) U.S. Cl. ..... 343/876; 343/702; 343/906

(58) Field of Classification Search ..... 343/876, 343/702, 906; 455/550, 558; 710/131
See application file for complete search history.

(56) References Cited

U.S. PATENT DOCUMENTS 6,131,136 A * 10/2000 Liebenow et al. ..... 710/316
6,274,829 B1 8/2001 Rankin
6,795,038 B2 9/2004 Choi
6,858,835 B2 2/2005 Smith
6,928,302 B1 8/2005 Kinney et al.
2003/0051178 A1* 3/2003 Liu ..... 713/300
2005/0048997 A1 3/2005 Grobler et al.
2005/0057404 A1 3/2005 Demicco et al.
2005/0079892 A1 4/2005 De Vos et al.
2005/0119029 A1 6/2005 Kinney et al.
2006/0026650 A1* 2/2006 Kim et al. ..... 725/62

FOREIGN PATENT DOCUMENTS

EP 1160911 A1 12/2001

OTHER PUBLICATIONS

International Search Report and Written Opinion, International Application No. PCT/CA2006/001719, dated Jan. 25, 2007.
U.S. Appl. No. 11/253,048, Office Action dated Mar. 14, 2007.

* cited by examiner

*Primary Examiner*—Hoang V Nguyen
(74) *Attorney, Agent, or Firm*—Nixon Peabody LLP

(57) ABSTRACT

Method and apparatus for selectively connecting one of an internal and an external antenna to an RF signal component of a wireless modem use a sensor mounted on the circuit board of the wireless modem. The sensor senses the presence of a connector of the external antenna, and issues a corresponding sensor output signal to a controller that controls a switch in order to alternatively connect one of the internal and external antennas to the RF signal component.

10 Claims, 6 Drawing Sheets

METHOD AND APPARATUS FOR SWITCHING BETWEEN INTERNAL AND EXTERNAL ANTENNAS IN A DEVICE SUCH AS PC-CARD MODEM

CROSS-REFERENCE TO RELATED APPLICATIONS

This application is a continuation of U.S. patent application Ser. No. 11/253,048, now U.S. Pat. No. 7,295,171, entitled "Method and Apparatus for Switching Between Internal and External Antennas in a Device Such as PC-Card Modem," filed Oct. 17, 2005.

BACKGROUND OF THE INVENTION

1. Field of the Invention

The invention relates to wireless modems, and more particularly, to a wireless modem having a sensor for sensing the presence of an external antenna connector and for configuring an electrical connection thereto from an RF signal component.

2. Description of the Related Art

Antennas that are internal to PC-Card wireless modems have limitations that typically provide worse performance than external antennas such as a traditional whip antenna. To get best overall performance from a modem with a built-in antenna, it is necessary to have a provision for an external antenna connection as well as the built-in antenna. The problem is that a method must be devised that will switch the correct antenna into play depending on whether the external antenna is installed or not. A second benefit of having an antenna switching method is that factory production test jigs can gain access to the modem antenna port via the external connector.

Prior art products such as AirCard™ AC580/AC5220™ from Sierra Wireless, Inc. have used an MC-Card type switched RF connector shown in FIG. 1. With this connector, when an external antenna cable is inserted, the AirCard™ internal antenna is disconnected from the RF front end by the MC-Card connector.

There may be several problems with the use of an MC-Card switched connector for the external antenna. For example, the MC-Card switched connector may be primarily designed as a factory test connector and may not be meant for use with external antenna and cables. The connector may not be mechanically strong enough to support an external antenna directly. A cabled connection must be used so that the connector is not stressed or impacted. Also, whip-antennas such as those of Sierra Wireless may have an SSMB type subminiature connector. The MC-Card connector is not compatible with SSMB. Therefore direct connectivity of those components is not possible. In addition, the conventional switched connector is not very reliable and will often stick and not switch over as it should. It may be sensitive to the heat of the soldering reflow process and can be damaged when the internal plastic insulation sleeve softened during reflow and the connector center pin shifted in the plastic. Finally, circuit board RF trace routing is not optimal with a switched connector because the signal trace must go first to the connector and then over the internal antenna. This long trace path to the internal antenna incurs signal loss.

BRIEF SUMMARY OF THE INVENTION

The aforementioned shortcomings in the prior art are addressed in accordance with the invention by separating the functions of detecting installation of an external antenna from the actual RF signal switching. This requires circuitry for detecting that an external antenna or antenna cable connector is inserted into the modem connector. In accordance with the invention, a method of detection and control of an internal RF switch that provide the same function as the switched connector but in a better way are provided.

BRIEF DESCRIPTION OF THE SEVERAL VIEWS OF THE DRAWINGS

Many advantages of the present invention will be apparent to those skilled in the art with a reading of this specification in conjunction with the attached drawings, wherein like reference numerals are applied to like elements, and wherein.

DETAILED DESCRIPTION OF THE INVENTION

Figure 1:
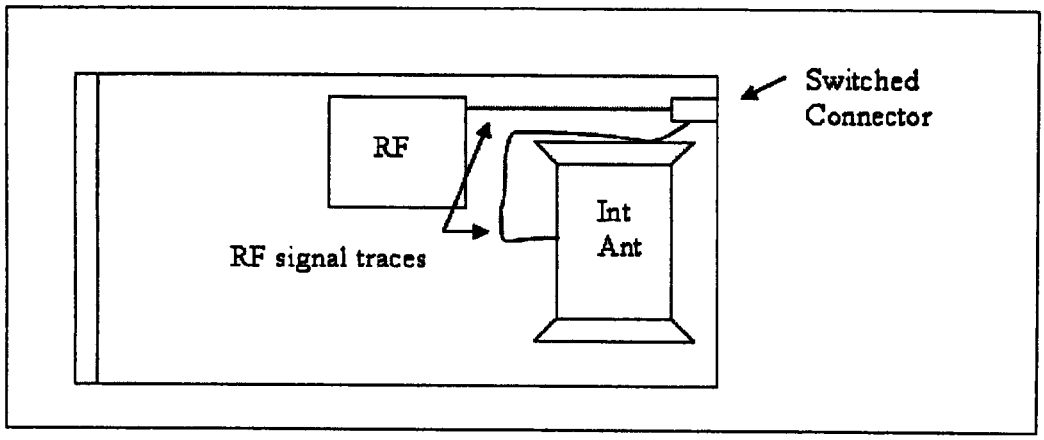
FIG. 1 is a schematic diagram of a prior art wireless card modem with a switched connector.
Figure 2:
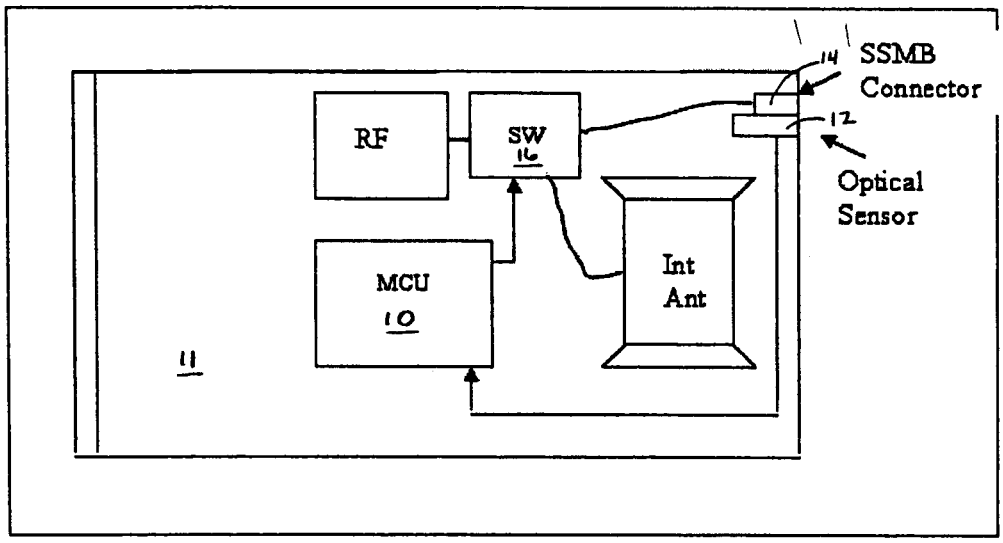
FIG. 2 is a schematic diagram of a wireless modem in accordance with the invention.

According to one aspect of the invention shown in FIG. 2, a Micro-Controller (MCU) 10 disposed on a PC-card modem PCB 11 is connected to an optical sensor 12 that detects when an external antenna or cable (not shown) is mated with the SSMB connector 14. When the external connection is detected, the MCU 10 sends a control signal to an RF switch 16 to direct the RF signal appropriately.

In factory test mode, the MCU 10 would set the switch 16 so that the RF front end is enabled to the external connector. This permits the factory test system (not shown) to make measurements via the external antenna connection rather than requiring a special RF test connector.

Figure 3:
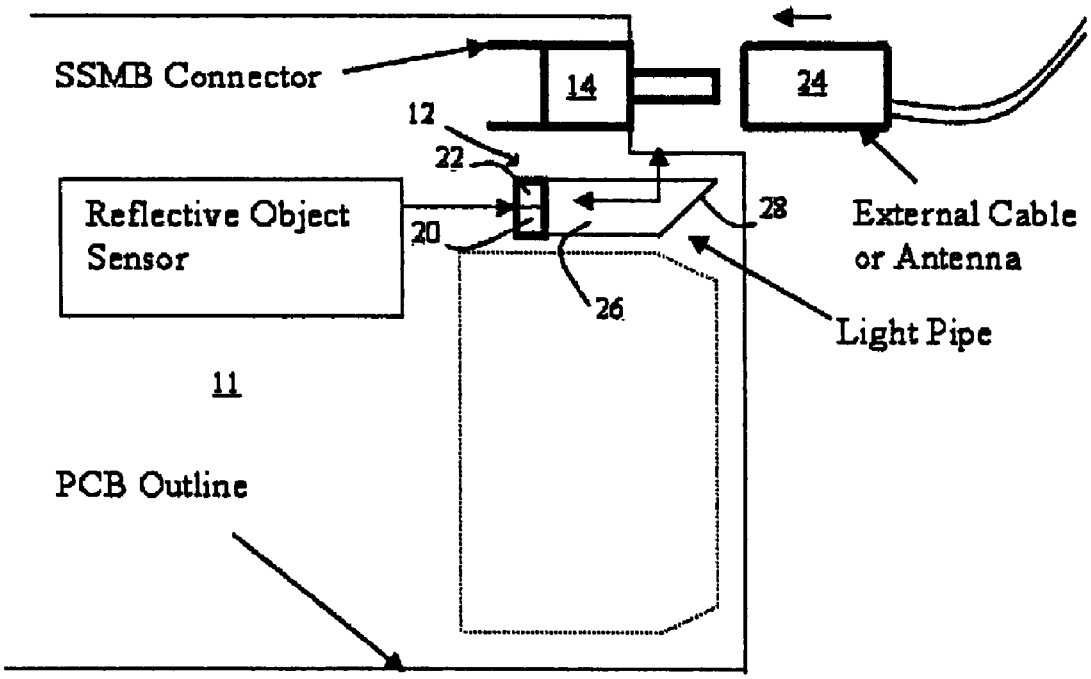
FIG. 3 is a schematic diagram of a wireless modem in accordance with the invention in which some details of a reflective optical sensor are shown.

The optical sensor 12, shown schematically in FIG. 3, utilizes a Reflective Object Sensor comprised of an infrared light emitting diode 20 and phototransistor 22 to detect the presence of a mating connector body 24. When the external connector is mated, the body of the connector reflects the infrared light and causes the phototransistor 22 to turn on. This event is detected by the MCU 10 via a processor general-purpose input port bit (not shown). The MCU 10 polls the photo-sensor on a periodic basis to determine if an external connector has been mated. A light guide 26 having a reflective surface 28 is provided for conveying the light to and from the connector location.

Figure 5:
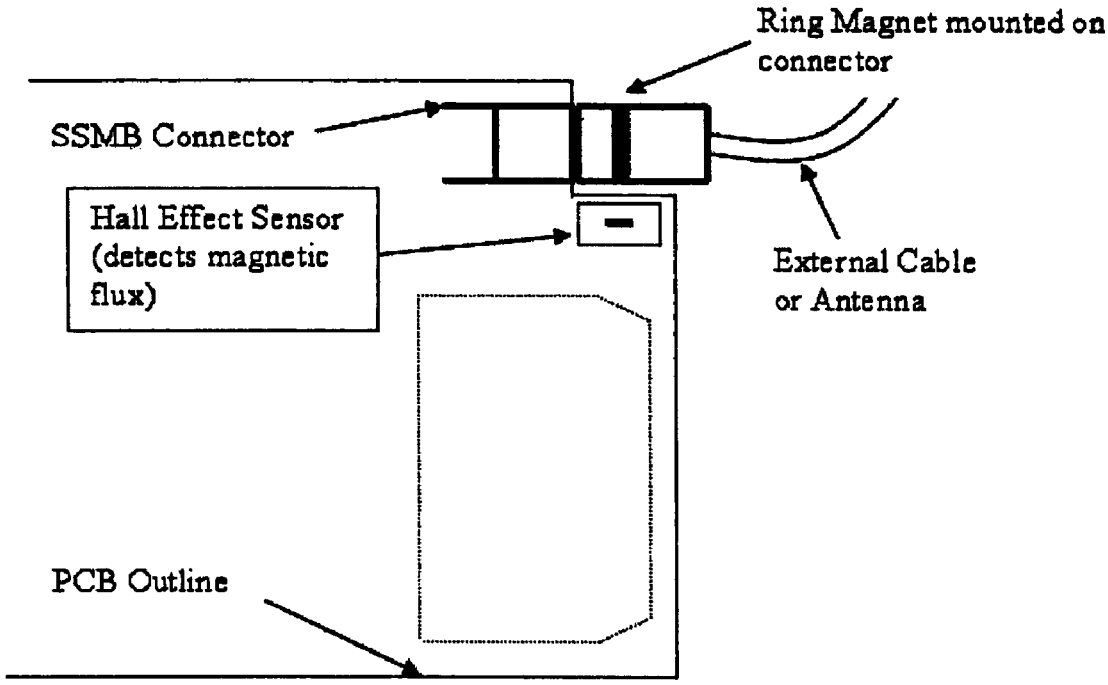
FIG. 5 is a schematic diagram of a wireless modem in accordance with the invention in which some details of a Hall Effect sensor are shown.
Figure 6:
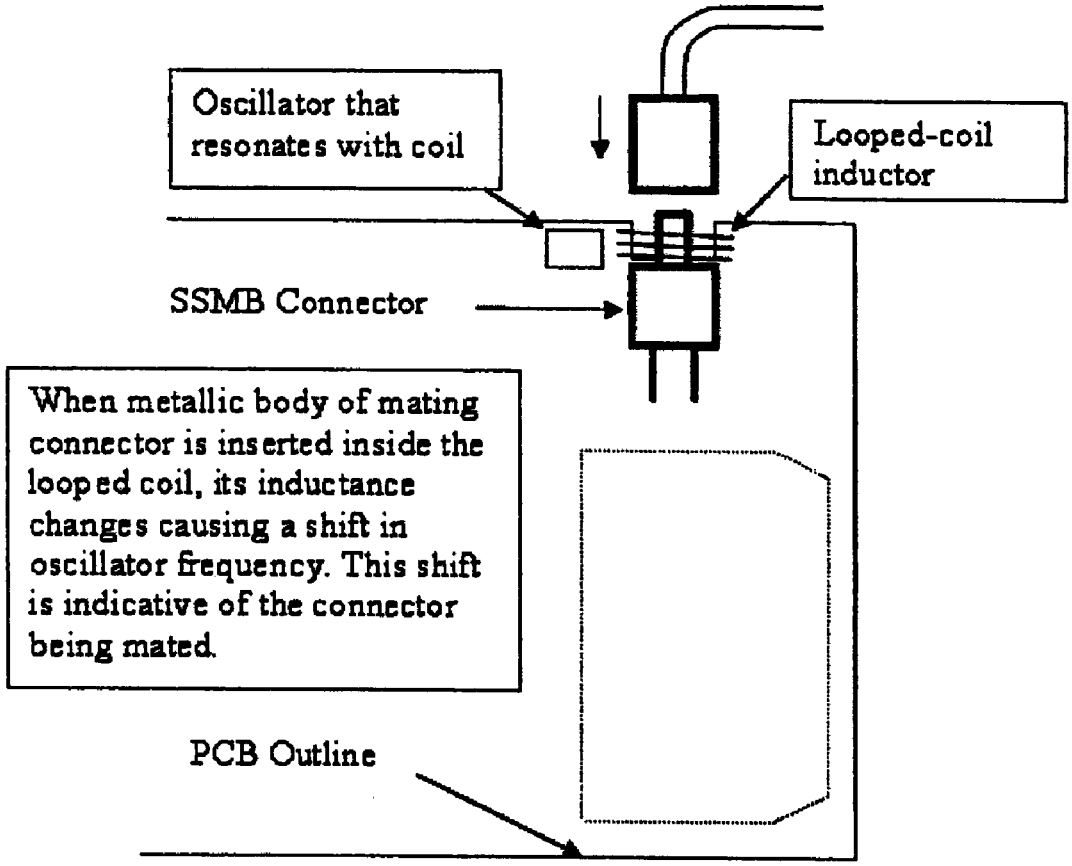
FIG. 6 is a schematic diagram of a wireless modem in accordance with the invention in which some details of an inductive pickup loop sensor are shown.

The reflective optical sensor is just one of the many ways to detect the presence of the mating connector. Other methods such as transmissive optical (FIG. 4), Hall Effect (FIG. 5), and inductive loop pickup (FIG. 6) can also be used.

A suitable reflective sensor is the Fairchild QRE1113.GR or SunLED XPI-A16. These sensors are surface mounted and can be mounted right-way up on the PCB 11 or upside down on the PCB 11 in a cut-out for more height clearance. As an example, the height of the sensor is 1.6 mm, allowing about 0.6 mm thickness for the light pipe (when inside a 5 mm thick PC-Card case). In this situation, it is an advantage to mount the sensor upside-down on the bottom of the PCB 11 with the sensor window projecting through a cut-out 30 in the PCB 11. This allows more thickness for the light pipe.

In an extended PC-Card form factor a suitable internal UMTS antenna is about 7 mm high so the PC-Card case must be raised at the section over the internal antenna. In this case the thickness of the light pipe is not a problem as more height is available.

Figure 4:
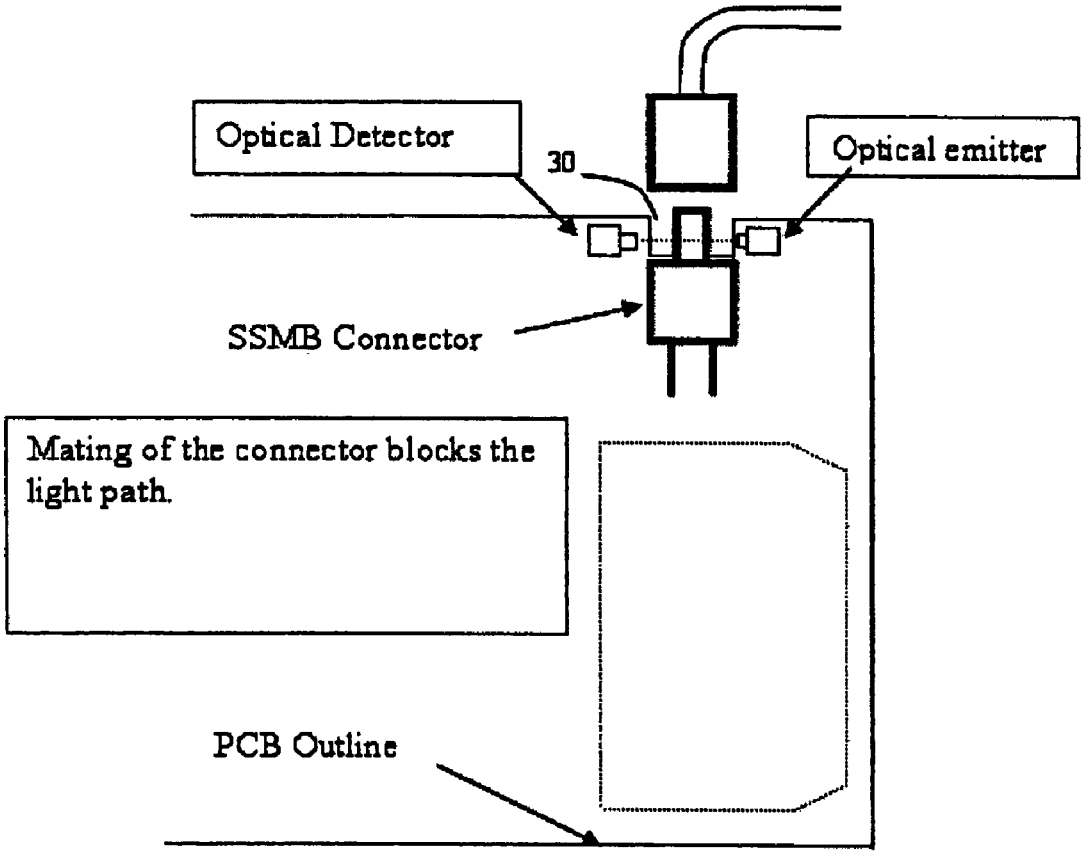
FIG. 4 is a schematic diagram of a wireless modem in accordance with the invention in which some details of a transmissive optical sensor are shown.

There are various possible orientations for the light pipe and sensor. FIG. 3 shows an example where the light is directed 90 degrees to reflect off the connector body. This orientation need not be the case depending on how much space is available under the internal antenna. The light pipe also directs the light from the horizontal to vertical planes to facilitate the optical sensor light axis. Alternatively, a transmissive optical sensor arrangement can be used. As shown in FIG. 4, another alternative can use a Hall Effect sensor, shown in FIG. 5, or an inductive pickup loop sensor, shown in FIG. 6.

The RF switch 16 can be of several types: coaxial relay, solid state, or new technology like semiconductor MEMs switch. Its function is Single-Pole Double Throw switching of the RF signal. This switch should be of a type that is controlled by an electrical signal, either statically applied or pulsed as with a latching relay. Advantages of the invention include providing a rugged, proven, connector solution (SSMB) and a device that may be implemented with all solid-state construction with no mechanical switching at low cost. The device can be low profile and fit in a 5 mm PC-Card case and can support factory testing without the need for an addition test connector.

The above are exemplary modes of carrying out the invention and are not intended to be limiting. It will be apparent to those of ordinary skill in the art that modifications thereto can be made without departure from the spirit and scope of the invention as set forth in the following claims.

The invention claimed is:

1. A wireless modem comprising:

a circuit board;

an internal antenna mounted on said circuit board;

an RF signal component mounted on said circuit board;

a first connector mounted on said circuit board, the first connector being matingly connectible with a corresponding second connector associated with an external antenna;

a sensor having a sensor output representative of the physical presence or absence of the second connector in mating relationship with the first connector; and a switch disposed in an electrical path between the RF signal component and the internal antenna, and between the RF signal component and the first connector, the switch being configured to establish either a direct electrical connection between the RF signal component and the internal antenna, or an indirect electrical connection that is by way of the first and second connectors between the RF signal component and the external antenna, depending on the sensor output.

2. The wireless modem of claim 1, wherein the sensor is optical.

3. The wireless modem of claim 2, wherein the sensor senses light reflection from the second connector.

4. The wireless modem of claim 2, wherein the sensor senses interruption of light transmission due to said second connector.

5. The wireless modem of claim 1, wherein the sensor detects magnetic flux.

6. The wireless modem of claim 1, wherein the sensor uses inductive loop pickup.

7. The wireless modem of the claim 1, wherein the first connector is an SSMB connector.

8. A method for establishing selective connectivity between an RF signal component and one of an internal and external antennas of wireless modem, the method comprising:

providing a first, SSMB connector on a circuit board of the wireless modem;

optically sensing the physical presence or absence of a second connector in mating relationship with the first connector, the second connector being in electrical communication with the external antenna; and connecting the RF signal component to the external antenna indirectly, by way of the first and second connectors, when the physical presence of the second connector is detected, or directly to the internal antenna when the physical presence of the second connector is not detected.

9. A method for establishing selective connectivity between an RF signal component and one of an internal and external antennas of wireless modem, the method comprising:

providing a first, SSMB connector on a circuit board of the wireless modem;

magnetically sensing the physical presence or absence of a second connector in mating relationship with the first connector, the second connector being in electrical communication with the external antenna; and connecting the RF signal component to the external indirectly, by way of the first and second connectors, when the physical presence of the second connector is detected, or directly to the internal antenna when the physical presence of the second connector is not detected.

10. A method for establishing selective connectivity between an RF signal component and one of an internal and external antennas of wireless modem, the method comprising:

providing a first, SSMB connector on a circuit board of the wireless modem;

using inductive loop pickup to sense the physical presence or absence of a second connector in mating relationship with the first connector, the second connector being in electrical communication with the external antenna; and connecting the RF signal component to the external antenna indirectly, by way of the first and second connectors, when the physical presence of the second connector is detected, or directly to the internal antenna when the physical presence of the second connector is not detected.

* * * * *